US006412672B1

(12) United States Patent
Adams

(10) Patent No.: US 6,412,672 B1
(45) Date of Patent: Jul. 2, 2002

(54) LADLE TO TUNDISH TRANSFER TO MOLTEN METAL IN THE STEELMAKING PROCESS

(75) Inventor: James S. Adams, Ashland, KY (US)

(73) Assignee: The Carmany Goup Incorporated, Russell, OH (US)

( * ) Notice: Subject to any disclaimer, the term of this patent is extended or adjusted under 35 U.S.C. 154(b) by 0 days.

(21) Appl. No.: 09/561,887

(22) Filed: May 1, 2000

(51) Int. Cl.[7] ..... B22D 41/08

(52) U.S. Cl. ..... 222/590; 222/606; 266/45; 266/236

(58) Field of Search ..... 222/590, 591, 222/594, 597, 606; 266/230, 236, 45

(56) References Cited

U.S. PATENT DOCUMENTS 3,554,520 A * 1/1971 Grosko ..... 222/606

4,913,404 A * 4/1990 Warman ..... 266/45

* cited by examiner

*Primary Examiner*—Scott Kastler
(74) *Attorney, Agent, or Firm*—Renner, Kenner, Greive, Bobak, Taylor & Weber

(57) ABSTRACT

A system for transferring molten metal (12) from a ladle (11) to a tundish (14) includes a nozzle (18) carried by the ladle (11) and having a bottom edge (30). A tube (19) has an upper edge (33) adapted to be positioned adjacent to the bottom edge (30) of the nozzle (18). The bottom edge (35) of the tube (19) is received in the tundish (14) and the passageway (32) in the tube (19) may receive a plug (39) to prevent slag (16) in the tundish (14) from entering the passageway (32). Either the bottom edge (30) of the nozzle (18) or the upper edge (33) of the tube (19) is generally spherical and engages a generally conical surface of the edge (30, 33) which is not spherical to form a seal between the nozzle (12) and the tube (19) irrespective of their precise alignment. The molten metal (12) may then pass from the ladle (11), through the nozzle (18), and through the tube (19) to displace the plug (39) and be received in the tundish (14).

14 Claims, 3 Drawing Sheets

LADLE TO TUNDISH TRANSFER TO MOLTEN METAL IN THE STEELMAKING PROCESS

TECHNICAL FIELD

This invention relates to a system for improving the quality of steel in the casting process. More particularly, this invention relates to improvements in the transfer of molten metal from a ladle to a tundish. More specifically, the present invention assures a sealed connection between the ladle and the tundish to prevent air from contacting the molten metal, and in another aspect, prevents the molten metal from being contaminated with slag from the tundish.

BACKGROUND ART

In the steel-casting process, molten metal is transferred from the furnace to a ladle which is then transported to the area of a tundish. Several ladles typically provide the molten metal to one tundish which, in turn, provides the molten metal to a continuous casting machine. The top surface of the metal, in both a ladle and in the tundish, is normally provided with a layer of slag to, among other things, prevent the contact of air with the molten metal inasmuch as it is very deleterious to the quality of the end product, the cast steel, if the molten metal has absorbed any oxygen or nitrogen.

Typically, a ladle full of molten steel is conveyed to a location over the tundish. The ladle carries a normally closed downwardly directed refractory nozzle through which the molten metal will ultimately be expelled through a refractory tube and into the tundish. The tube is positioned, by a steelworker, adjacent to the nozzle, and once the tube is properly aligned with the nozzle, it is fixed in position. The ladle and tube are then lowered into the tundish, with the tube extending through the slag layer on top of the molten metal already in the tundish. The ladle nozzle is then opened and the molten metal flows through the nozzle and the tube and into the tundish. Molten metal from the bottom of the tundish is continually being transferred to a steel casting machine. When the ladle has transferred its load of molten metal to the tundish, it is raised to its original position, the tube is removed, and it is conveyed away as the tundish awaits its next load of molten metal from the next ladle at which time the whole process is repeated.

A problem relating to the contamination of the molten metal with air exists with the aforedescribed process. The bottoms of known ladle nozzles are provided with a conical surface which is intended to be aligned with, and thereby perfectly match, a conical surface formed at the top of the tube so that air cannot pass between the nozzle and the tube. The problem is, however, that such perfect alignment between the nozzle and the tube is not readily obtained. Since the steelworker cannot get too close to the ladle and the tundish, the tube is usually connected, in a gimbal-like fashion, to the end of a long rod. The tube must then be maneuvered into attempted alignment with the nozzle of the tundish before being locked in place. But if, as is often the case, the alignment is not perfect, the conical surface of the nozzle and the tube will not perfectly mate. As a result, a gap is formed whereby air can come into contact with the molten metal as it passes from the ladle to the tundish.

Another problem exits in known steelmaking systems which relates to the potential contamination of the molten metal by the slag in the tundish. With the tube positioned adjacent to the nozzle, as the ladle is lowered to insert the tube through the slag and into the molten metal in the tundish, it is highly likely that slag will back up and be received within the tube. Then, when the ladle nozzle is opened, the molten metal from the ladle will pass through the nozzle and tube, thereby expelling the slag in the tube into the molten metal in the tundish. Such adversely effects the quality of the resulting cast steel.

In short, the need exists to improve the quality of steel in the casting process by eliminating these problems at the area of the transfer of the molten metal from a ladle to the tundish.

DISCLOSURE OF THE INVENTION

It is thus a primary object of the present invention to provide a system to improve the quality of cast steel.

It is another object of the present invention to provide a system, as above, which does not permit the molten metal to be exposed to air when being transferred from a ladle to the tundish.

It is a further object of the present invention to provide a system, as above, which prevents any air gap between the nozzle of a ladle and the tube which is inserted into the molten metal of the tundish irrespective of the precise alignment between the nozzle and the tube.

It is an additional object of the present invention to provide a system, as above, which does not permit the slag, which covers the molten metal in the tundish, to contaminate that molten metal.

It is yet another object of the present invention to provide a system, as above, which prevents the tundish slag from being received in the tube before the molten metal in a ladle is permitted to pass through the tube.

These and other objects of the present invention, as well as the advantages thereof over existing prior art forms, which will become apparent from the description to follow, are accomplished by the improvements hereinafter described and claimed.

In general, in accordance with one aspect of the present invention, a system for transferring molten metal from a ladle to a tundish includes a nozzle having a first end communicating with the ladle and having a second end. A tube has a first end adapted to be positioned adjacent to the second end of the nozzle and has a second end adapted to communicate with the tundish. Either the second end of the nozzle or the first end of the tube is generally spherically shaped so as to form a seal between the tube and the nozzle such that the molten metal may pass through the nozzle and the tube and into the tundish.

In accordance with another aspect of the present invention, a system for transferring molten metal from a ladle to a tundish includes a nozzle having a first end communicating with the ladle and having a second end. A tube has a first end adapted to be positioned adjacent to the second end of a nozzle and a second end adapted to communicate with the tundish. A plug is adapted to be positioned in the second end of the tube such that when the molten metal passes from the ladle through the nozzle and the tube, the plug is displaced from the second end of the tube and the molten metal is received in the tundish.

The method of transferring molten metal from a ladle to a tundish utilizing the system includes the steps of positioning the ladle over the tundish, positioning one end of a tube adjacent to one end of a nozzle carried by the ladle, sealing the junction between the nozzle and the tube by forming one of the ends with a spherical surface, lowering the ladle, nozzle and tube toward the tundish, and thereafter allowing the molten metal to pass through the nozzle and the tube and into the tundish.

The system has applications for transferring a fluid from a first container to a second container wherein a first tubular member has a first end communicating with the first container and has a second end. A second tubular member has a first end adapted to be positioned adjacent to the second end of the first tubular member and has a second end adapted to communicate with the second container. Either the second end of the first tubular member or the first end of the second tubular member is generally spherical so that when the second end of the first tubular member and the first end of the second tubular member are positioned adjacent to each other, a seal is formed between the first and second tubular members.

A preferred exemplary system for transferring molten metal from a ladle to a tundish according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
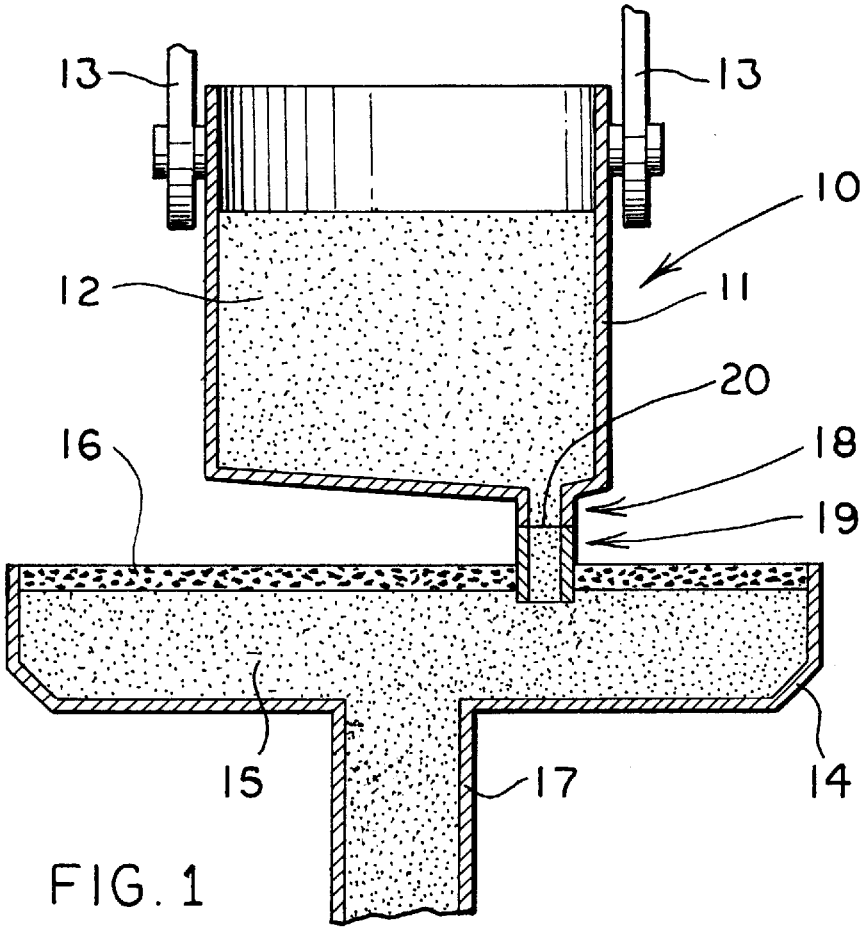
FIG. 1 is a schematic representation showing the relationship of a ladle and a tundish in the steelmaking process.

The portion of the steelmaking process or system to which the present invention relates is schematically shown in FIG. 1 and generally indicated by the numeral 10. System 10 includes a conventional ladle 11 which is filled with molten metal 12 and transported by a schematically shown conveying system 13 to an area vertically over a conventional tundish 14. Tundish 14 is likewise filled with molten metal 15 which is covered by a layer of slag 16. The molten metal 15 in tundish 14 is continually being provided to a continuous steel casting machine, a portion of which is schematically indicated by the numeral 17 in FIG. 1. The metal 15 is kept from being depleted by the metal 12 in ladle 11 which passes through a tubular nozzle, generally indicated by the numeral 18, formed at the bottom of ladle 11, through a tube, generally indicated by the numeral 19, and into the tundish 14. When the molten metal 12 of a ladle 11 is depleted, conveying system 13 moves it away and brings on another ladle 11 so as to maintain the process continuous.

One aspect of the present invention relates to the manner in which the junction between nozzle 18 and tube 19, schematically shown as numeral 20 in FIG. 1, is maintained air tight. As previously described, tube 19, which can be as much as five feet in length, must be manipulated on the end of a rod to be properly positioned relative to nozzle 18. As a result, alignment between tube 19 and nozzle 18 has been difficult to achieve.

Figure 2:
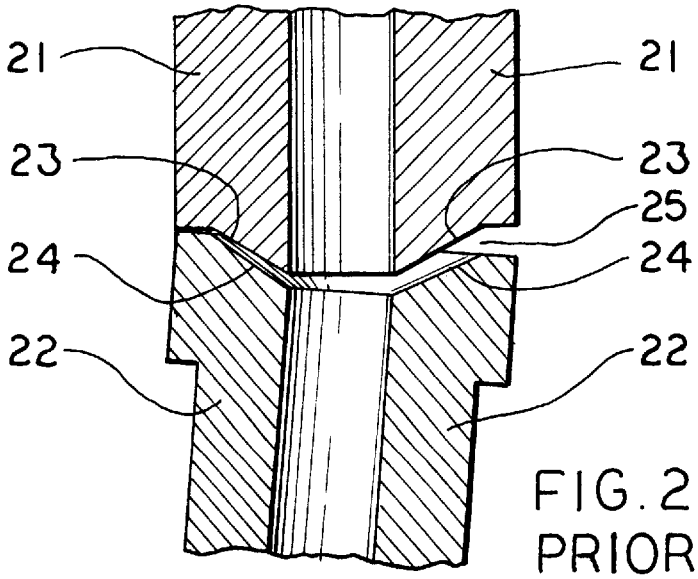
FIG. 2 PRIOR ART
FIG. 2 is a fragmented, schematic, longitudinal sectional view of the prior art ladle nozzle and tube showing the problem of misalignment between the nozzle and the tube.

Before describing the manner in which the present invention solves this problem, reference is made to FIG. 2 which depicts the prior art with its misalignment problems. The prior art nozzle is indicated by the numeral 21 and the prior art tube is indicated by the numeral 22. The mating surfaces of each are conical in configuration, that is, the bottom edge surface 23 of nozzle 21 is conical and the top edge surface 24 of tube 22 is conical. However, surfaces 23 and 24 will only sealingly mate if tube 22 is perfectly aligned with nozzle 21. When a tube 22 is tilted with respect to a nozzle 21, that is, not vertically aligned with the nozzle 21, as shown in FIG. 2, a gap 25 is formed between nozzle 21 and tube 22 which deleteriously exposes the molten metal passing therethrough to air.

Figure 3:
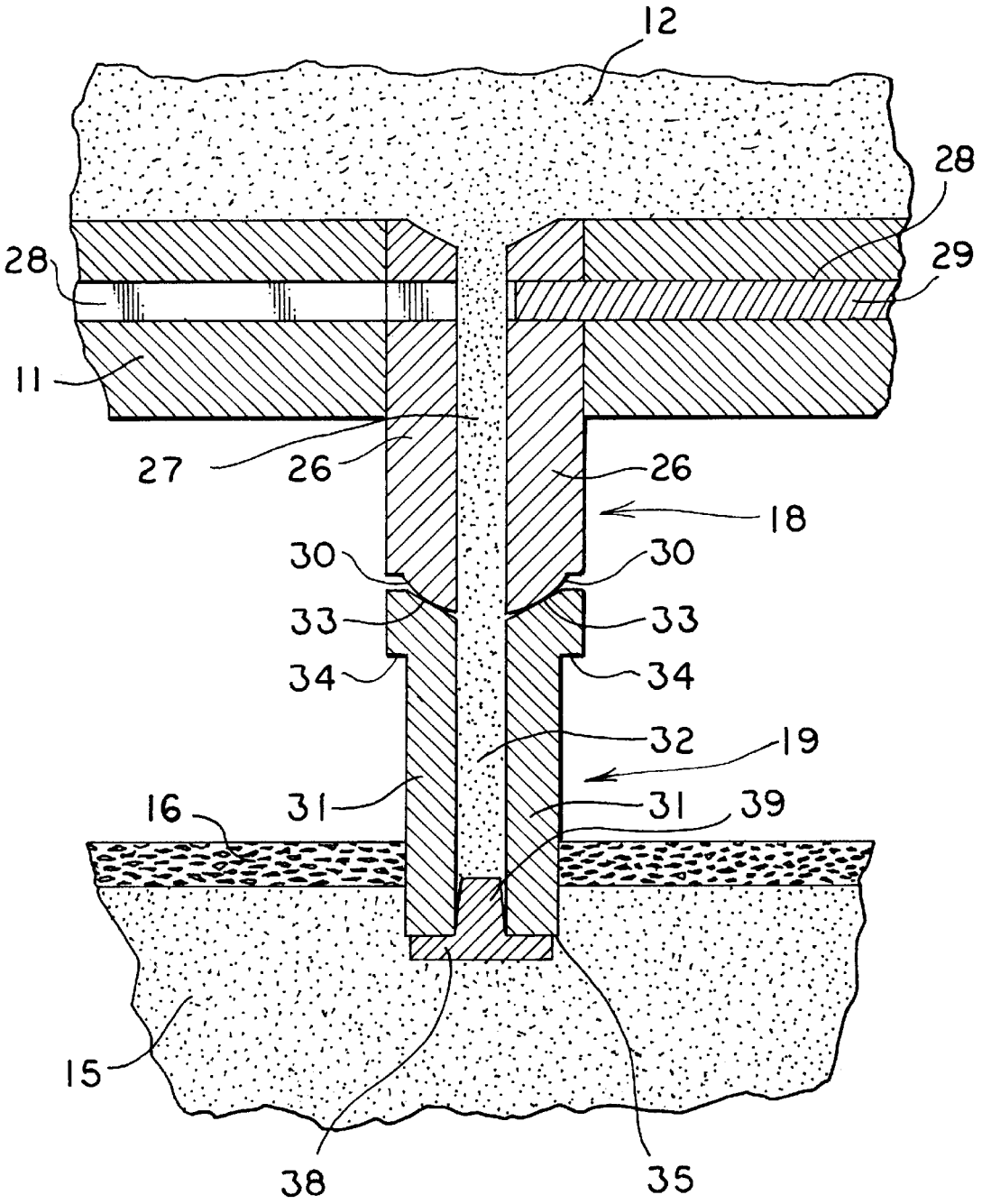
FIG. 3 is a fragmented, schematic, longitudinal sectional view of the ladle and tundish of FIG. 1, showing the nozzle and tube made in accordance with the present invention.
Figure 5:
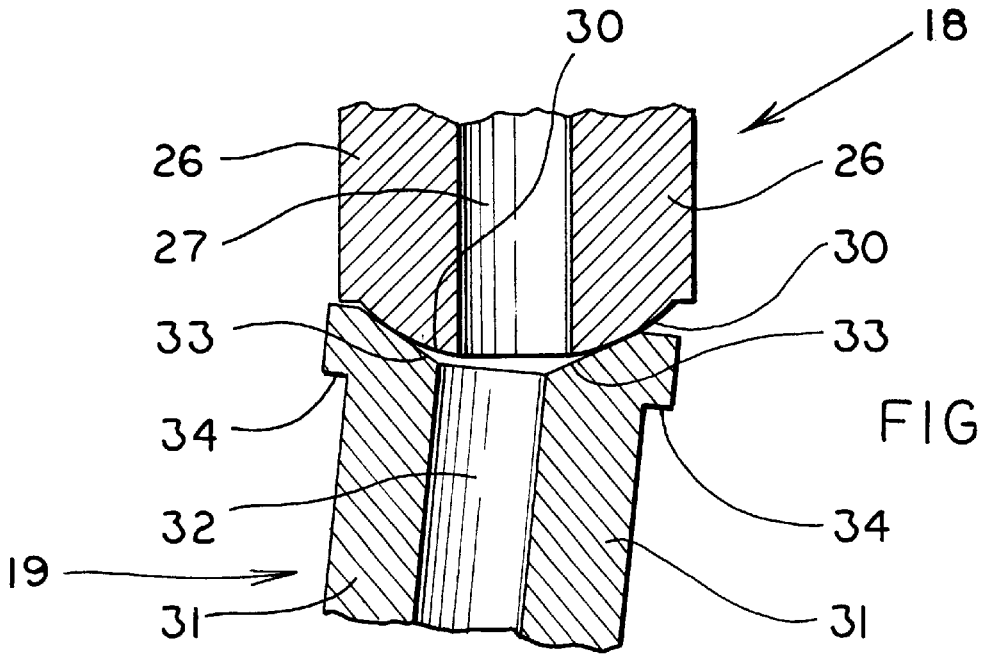
FIG. 5 is a fragmented, schematic, longitudinal sectional view of the nozzle and tube of FIG. 3 showing a misalignment such as shown in FIG. 2 with respect to the prior art.
Figure 4:
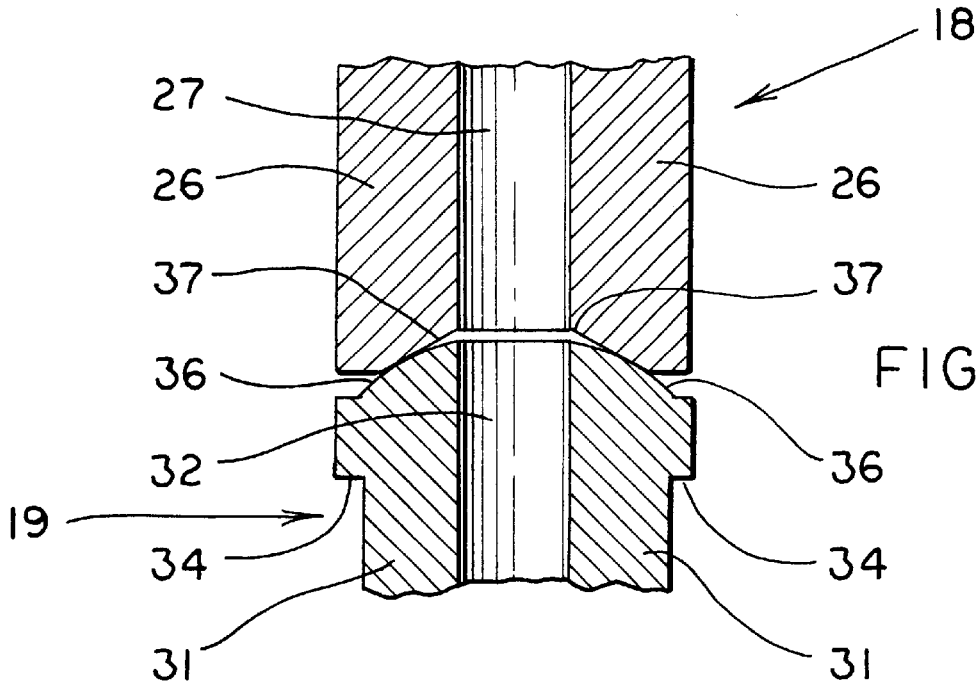
FIG. 4 is a fragmented, schematic, longitudinal sectional view of an alternative embodiment of the nozzle and the tube of FIG. 3.

The manner in which the present invention solves this problem is shown in FIGS. 3–5. Nozzle 18 is in the form of a tube having a generally cylindrical side wall 26 with a passageway 27 being defined generally centrally thereof. The top of passageway 27 is adapted to communicate with the molten metal 12 in tundish 11. A generally horizontal slot 28 is formed in tundish 11 and extends on both sides of passageway 27. A slide valve 29 is positioned in slot 28 and may be cylinder operated to move in slot 28 to open and close the communication of passageway 27 with the molten metal 12. As shown in FIG. 3, passageway 27 is in communication with the molten metal 12, but if slide valve 29 is moved to the left, as viewed in FIG. 3, such communication is closed.

The bottom edge 30 of side wall 26 is arcuate in nature, forming an overall spherical configuration. That is, in any longitudinal section taken through nozzle 18, bottom edge 30 of the diametrically opposed side wall 26 forms a spherical segment.

Tube 19, which is made of a refractory material, includes a cylindrical side wall 31 with a passageway 32 being defined centrally thereof. The upper edge 33 of tube 19 is configured in an overall conical configuration. That is, in any longitudinal section taken through tube 19, upper edge 33 of the diametrically opposed side wall 26 forms a conical segment.

As previously described, with slide valve 29 closing passageway 27 of nozzle 18, a ladle 11 full of molten metal 12 is positioned above a tundish 14 by conveying system 13. Then the steelworker manipulates tube 19, which is carried on the end of a long rod in a gimbal-like connection, into position, attempting to align passageway 27 with passageway 32, and nozzle bottom edge 30 with tube upper edge 33. Once it is believed that alignment has taken, place, a hydraulic cylinder or other mechanical device (not shown) acts on a shoulder 34 formed on side wall 31 of tube 19 to urge tube 19 upwardly and hold its upper edge 33 against the bottom edge 30 of nozzle 18. The ladle 11, with the nozzle 18 and tube 19 so positioned, is then lowered toward tundish 14, with the bottom edge 35 of tube 19 passing through the layer of slag 16 and into the molten metal 15 in tundish 14. Slide valve 29 is then opened and molten metal 12 from ladle 11 is allowed to flow through passageway 27 of nozzle 18, through passageway 32 of tube 19, and into tundish 14. Such is the position shown in FIG. 3.

Of importance is the fact that no matter how accurate an alignment of upper edge 33 of tube 19 and bottom edge 30 of nozzle 18 is achieved, there will be no air gaps between edge 33 and edge 30. This is because one of the edges, bottom edge 30 of nozzle 18 as shown in FIG. 3, is spherical with the other edge, upper edge 33 of tube 19 as shown in FIG. 3 being conical. Thus, there will always be some point of contact (seal) between the edges 30 and 33. As shown in FIG. 4, it should be apparent that the spherical edge need not be on the nozzle 19. Rather, the upper edge 36 of the tube 19 shown in FIG. 4 may be spherical and the bottom edge 37 of the nozzle 18 shown in FIG. 4 may be conical without departing from the concept of the present invention—it being important only that one of the edges is spherical.

While tube 19 is shown in FIGS. 3 and 4 as being perfectly aligned with nozzle 18, FIG. 5 demonstrates that even if misaligned, the sealing relationship is achieved. Thus, as shown in FIG. 5, if tube 19 were to be tilted relative to nozzle 18, that is, not vertically aligned with nozzle 18, a circumferential seal is still obtained. This is to be contrasted with the same misalignment shown in the prior art FIG. 2 where a gap 25 is formed.

Another problem in the steelmaking process, as previously described, is that as the ladle 11 with tube 19 attached thereto is being lowered toward the tundish 14, and before valve 29 is opened, slag 16 is likely to back up into tube passageway 32 as tube 19 passes through slag 16. Then, when valve 29 is opened, the molten metal 12 in the ladle 11 forces that slag 16 into the molten metal 15 of tundish 14 thereby contaminating the resulting steel. As a solution to this problem, as shown in FIG. 3, the present invention provides a plug 38 having a stem 39 which is adapted to be received in the bottom of tube passageway 32. Plug 38 is preferably formed of a material that will readily dissolve in the molten metal 15 of tundish 14. As a result, as tube 19 is lowered through the layer of slag 16, passageway 32 will be maintained free of such slag. Then, when in the position shown in FIG. 3, when valve 29 is opened, the molten metal 12 received in passageway 32 will dislodge plug 38 which will dissolve in the molten metal 15 of tundish 14.

In view of the foregoing, it should be evident that a system constructed in accordance with the present invention substantially improves the quality of the steel and otherwise accomplishes the objects of the present invention to improve the steelmaking art.

What is claimed is:

1. A system for transferring molten metal from a ladle to a tundish comprising a nozzle having a first end communicating with the ladle and having a second end; and a tube having a first end adapted to be positioned adjacent to said second end of said nozzle and having a second end adapted to communicate with the tundish; the molten metal being adapted to pass from the ladle, through said nozzle and said tube, and into the tundish; one of said second end of said nozzle or said first end of said tube having surfaces defining a sphere and the other of said second end of said nozzle or said first end of said tube having surfaces defining a cone so that when said second end of said nozzle and said first end of said tube are positioned adjacent to each other, the junction between said nozzle and said tube is sealed even if said second end of said nozzle and said first end of said tube are not perfectly aligned.

2. A system according to claim 1 wherein said second end of said nozzle has said surfaces defining a sphere.

3. A system according to claim 2 wherein said first end of said tube has surfaces defining a cone.

4. A system according to claim 1 wherein said first end of said tube has said surfaces defining a sphere.

5. A system according to claim 4 wherein said second end of said nozzle has surfaces defining a cone.

6. A system according to claim 1 further comprising a plug adapted to be positioned in said second end of said tube.

7. A system according to claim 6 wherein said plug is made of a material which will dissolve in the molten metal.

8. A system for transferring molten metal from a ladle into a tundish comprising a nozzle having a first end communicating with the ladle and having a second end; a tube having a first end adapted to be positioned adjacent to said second end of said nozzle and having a second end adapted to communicate with the tundish; one of said second end of said nozzle or said first end of said tube being generally spherical and the other of said second end of said nozzle or said first end of said tube being generally conical; and a plug adapted to be positioned in said second end of said tube; the molten metal being adapted to pass from the ladle, through said nozzle, and through said tube thereby displacing said plug from said second end of said tube so that the molten metal is received in the tundish.

9. A system according to claim 8 wherein said plug is made of a material which will dissolve in the molten metal.

10. In a system for transferring a fluid from a first container to a second container, a first tubular member having a first end communicating with the first container and having a second end; a second tubular member having a first end adapted to be positioned adjacent to said second end of said first tubular member and having a second end adapted to communicate with the second container; one of said second end of said first tubular member or said first end of said second tubular member being generally spherical and the other of said second end of said first tubular member or said first end of said second tubular member being generally conical so that when said second end of said first tubular member and said first end of said second tubular member are positioned adjacent to each other, a seal is formed between said first and second tubular members.

11. A method of transferring molten metal from a ladle to a tundish comprising the steps of positioning the ladle over the tundish, positioning one end of a tube adjacent to one end of a nozzle carried by the ladle, sealing the junction between the nozzle and the tube without having to perfectly align the nozzle and the tube by forming one of the ends with a spherical surface and the other of the ends with a conical surface, lowering the ladle, nozzle and tube toward the tundish, and thereafter allowing the molten metal to pass through the nozzle and the tube and into the tundish.

12. A method according to claim 11 further comprising the step of placing a plug in the other end of the tube before lowering the ladle.

13. A method according to claim 12 wherein the step of allowing the molten metal to pass through the nozzle and the tube dislodges the plug from the tube.

14. A method according to claim 13 wherein the step of allowing the molten metal to pass through the nozzle and the tube includes the step of opening a valve in the ladle.

* * * * *